US008347426B2

(12) United States Patent
Valdenaire

(10) Patent No.: US 8,347,426 B2
(45) Date of Patent: Jan. 8, 2013

(54) SHOWER DEVICE LEVEL WITH THE SURROUNDING GROUND

(75) Inventor: Jacques Valdenaire, La Bresse (FR)

(73) Assignee: Societe Nouvelle Jedo, Le Thillot (FR)

( * ) Notice: Subject to any disclaimer, the term of this patent is extended or adjusted under 35 U.S.C. 154(b) by 0 days.

(21) Appl. No.: 13/121,454

(22) PCT Filed: Sep. 29, 2009

(86) PCT No.: PCT/FR2009/051852

§ 371 (c)(1),
(2), (4) Date: Jun. 10, 2011

(87) PCT Pub. No.: WO2010/034959

PCT Pub. Date: Apr. 1, 2010

(65) Prior Publication Data

US 2011/0231991 A1 Sep. 29, 2011

(30) Foreign Application Priority Data

Sep. 29, 2008 (FR) ..... 08 56539

(51) Int. Cl.
*A47K 3/00* (2006.01)

(52) U.S. Cl. ..... 4/613

(58) Field of Classification Search ..... 4/596–614
See application file for complete search history.

(56) References Cited

U.S. PATENT DOCUMENTS 6,240,578 B1 6/2001 Planella

FOREIGN PATENT DOCUMENTS

| | | | |
|---|---|---|---|
| DE | 198 47 204 | C1 | 3/2000 |
| DE | 20 2006 009037 | U1 | 8/2006 |
| DE | 10 2006 026707 | A1 | 12/2007 |
| GB | 2 306 316 | A | 5/1997 |

OTHER PUBLICATIONS

International Search Report, dated Jan. 28, 2010, from corresponding PCT application.

*Primary Examiner* — Lori Baker
(74) *Attorney, Agent, or Firm* — Young & Thompson

(57) ABSTRACT

A shower device level with a surrounding floor includes a surface for recovering waste water combined with an element for draining the water. The recovery surface includes a tub embedded in the floor, whose peripheral edge, over all or part of its periphery, is essentially flush with the floor, and a detachable support element, forming the shower floor, essentially at a level with the surrounding floor, in an operative position, so as to form a surface continuity between the latter and the detachable support element. The peripheral edge of the tub includes a preferably flat seat surface, and the tub is supported in a recess of the floor at least by the seat surface that rests on a belt of the recess at a level below that of the surrounding floor, and the seat surface extends by a raised surface whose upper edge is essentially flush with the surrounding floor.

18 Claims, 4 Drawing Sheets

SHOWER DEVICE LEVEL WITH THE SURROUNDING GROUND

FIELD OF THE INVENTION

This invention has as its object, in the field of bathroom equipment and more particularly showers, a shower device that is level with the surrounding floor.

Surrounding floor is defined as the surface of the floor that surrounds the shower space that can be, for example, the surface on the floor of tiles laid on said floor or any other type of material that covers the latter.

BACKGROUND OF THE INVENTION

It is known that a shower comprises a surface for recovery of waste water that forms the base of the shower space that is combined with a means for draining said water, such as a siphon, which recovery surface generally comes in the form of a more or less wide and deep tub of an overall square or rectangular shape, equipped with a peripheral edge that generally comprises a flat seat surface, whereby said tub is designed to be placed either on the floor or embedded in a recess that is made in the floor of a bathroom.

Such a shower receiving tub is usually placed in a wall space that is delimited by a wall side that is equipped with a water distribution installation or by several wall sides, in general two or three wall sides at a right angle of which at least one is equipped with a water distribution installation.

When the tub is embedded, the latter is supported in the recess that is made in the floor of the bathroom by its base that rests on the horizontal flat surface that forms the base of said recess, directly or by means of an integrated base or blocks and/or by the seat surface of its peripheral edge that rests on the horizontal peripheral flat surface or belt that surrounds said recess by means of a support seal that ensures the tight connection between the peripheral edge of the tub and the recess.

However, if these receiving tubs allow a relatively easy implementation of their installation, they allow edges or raised-surface parts to appear at the entry to the shower space relative to the surrounding floor that do not allow good accessibility, in particular for individuals who are elderly or handicapped. Furthermore, the differences in level between the surrounding floor and the surface for recovery of waste water from the shower impart an appearance that is not very aesthetically pleasing and is not in keeping with the décor of the bathroom, as well as giving an impression of decreased space.

To eliminate these drawbacks, level showers that are commonly called "Italian-style showers," whose surface for recovery of waste water is flush with the surrounding floor, are also known. Such a recovery surface is generally curved or consists of gentle slopes that converge toward a drainage siphon that can be in a position that is central or offset or toward drains, combined with a particular siphon system and arranged along all or part of the circumference of the floor of the shower.

However, while a so-called "Italian-style" shower has a more aesthetically pleasing appearance than the standard showers and offers level accessibility without leaving obvious cuts, while making it possible in particular to make varied shapes and to integrate the same finish as that of the bathroom, it requires a complete ground seal to ensure good behavior over time and to prevent degradation due to infiltration and moisture.

In this type of shower, the watertightness of the floor of the shower and the joints between the latter and the adjacent wall sides is conventionally ensured using a zinc or lead sheet that goes back up the latter and on which is cast a waterproof concrete covering with multiple slopes, generally four slopes, or, as is the case for the current trend, using a PVC film that integrates a siphon bond and on which film a covering with several slopes is cast. Other molded devices that integrate a siphon, such as panels made of high-density PSE, are able to be laid in a recess that is made in the floor.

The installation of an Italian-style shower is therefore complex and should be done very carefully, preferably by professionals, in particular for the production of slopes of the surface for the recovery of waste water on which the proper flow of waste water depends.

In the case where the installation is not carried out correctly, which is common when the installer is not sufficiently skilled in this regard, considerable damage and a high repair cost as well as significant compensation fees may result when the damage done affects the surrounding area.

SUMMARY OF THE INVENTION

This invention has as its object to remedy these drawbacks by proposing a level shower device that makes possible good accessibility in the shower space, is easy to install while ensuring a complete seal, and offers the aesthetically pleasing side and the advantages of layout and personalization of so-called "Italian-style" showers by the surface continuity created between the surrounding floor and the floor of the shower.

The shower device that is level with the surrounding floor according to the invention—which comprises a surface for recovery of waste water combined with a means for draining said water, whereby said recovery surface consists of a tub that is embedded in the floor, whose peripheral edge, over all or part of its periphery, is essentially flush with said surrounding floor, and a detachable support element, forming the floor of the shower, essentially at a level with said surrounding floor, in an operative position, in such a way as to form a surface continuity between the latter and the detachable support element—is characterized essentially in that said peripheral edge of the tub comprises a preferably flat seat surface, in that the tub is supported in a recess of the floor at least by said seat surface that rests on a belt of said recess at a level below that of the surrounding floor, and in that said seat surface extends by a raised surface whose upper edge is essentially flush with the surrounding floor.

The shower device according to this invention will advantageously comprise sealing means between the tub and the surrounding floor.

In a first embodiment of the tub according to the invention in a shower space, the entire periphery of the peripheral edge of the tub is essentially flush with the surrounding floor.

In a second embodiment of the tub according to the invention in a shower space, the latter is embedded in a wall space in such a way that the peripheral edge of said tub, on a portion of its periphery, is essentially flush with the surrounding floor while the other portion of its periphery is adjacent to at least one wall side.

BRIEF DESCRIPTION OF THE DRAWINGS

The invention will be better understood using the description below, which relates to a preferred embodiment, provided by way of nonlimiting example and explained with reference to the accompanying diagrammatic drawings, in which.

DETAILED DESCRIPTION OF THE INVENTION

Figure 1A:
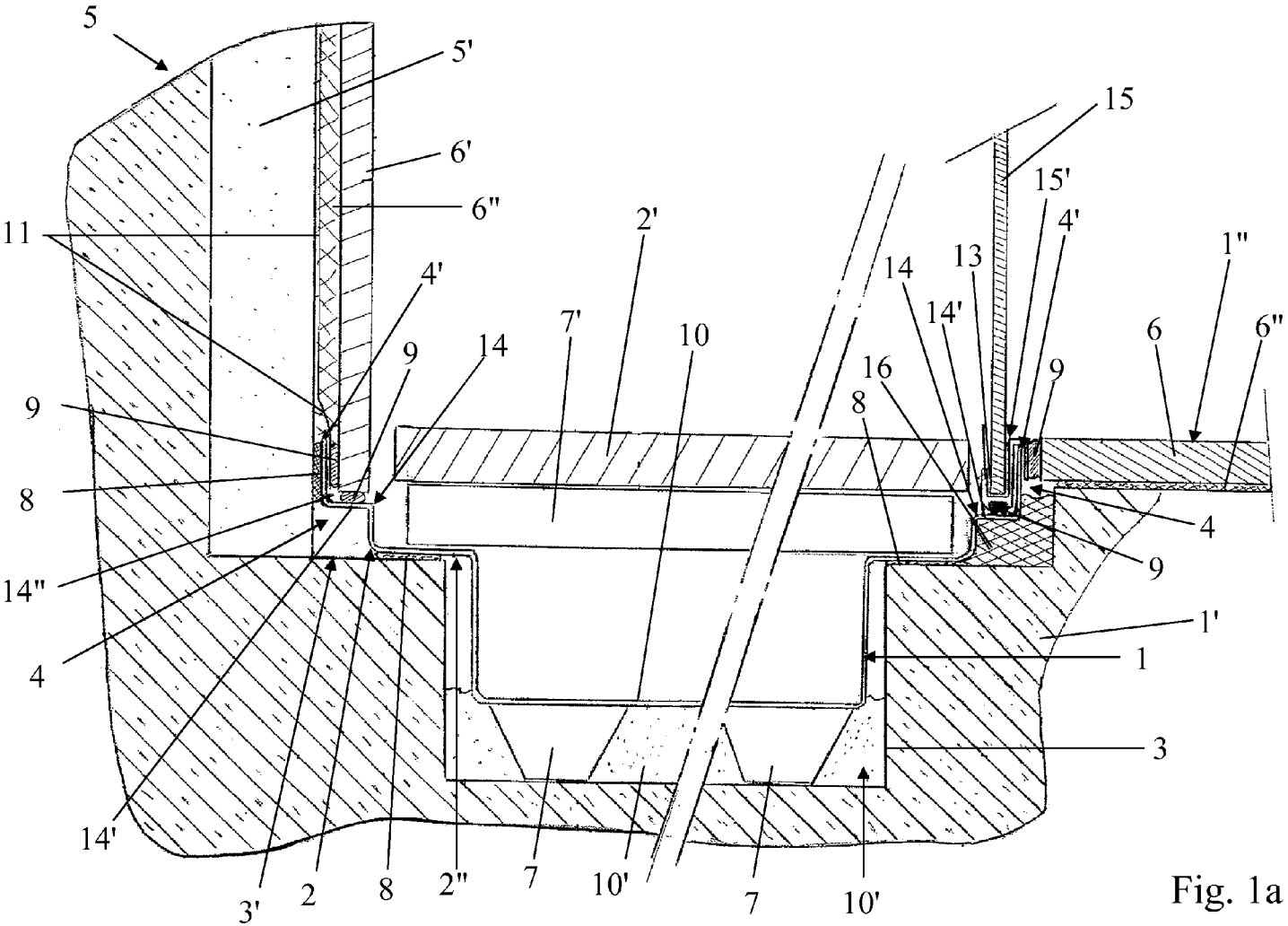
FIG. 1*a* is a transverse cutaway view of the lower portion of a level shower according to a preferred embodiment of the invention.
Figure 2:
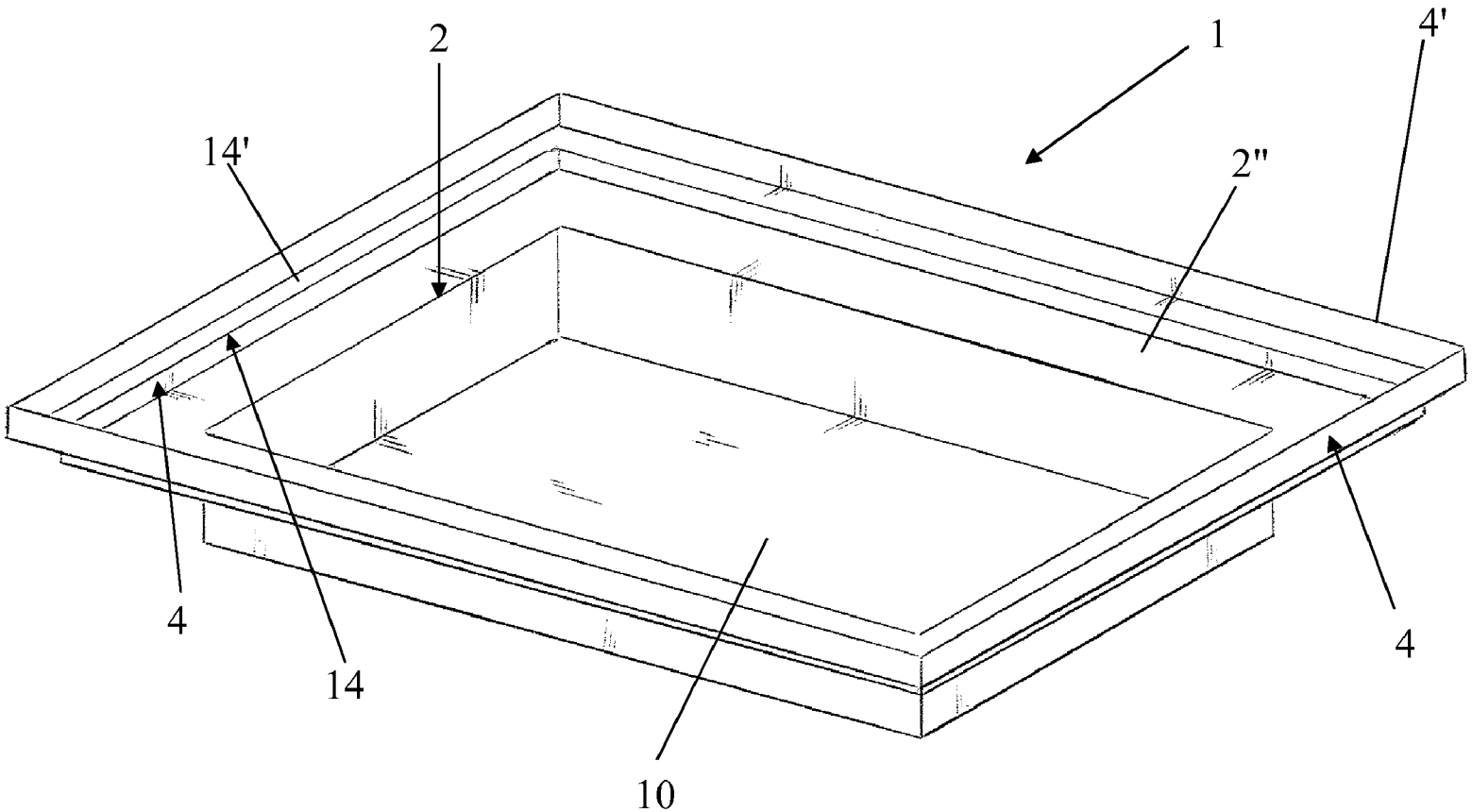
FIG. 2 is a perspective view of a shower tub according to the invention.

If reference is made to FIG. 1*a* and to FIG. 2, it is possible to see a shower device that is level with the surrounding floor 1" according to this invention, comprising a surface for recovery of waste water combined with a means for draining said water, whereby said recovery surface consists of a tub 1 that is embedded in the floor 1', whose peripheral edge 2, over all or part of its periphery, is essentially flush with said surrounding floor 1", and a detachable support element 2', forming the floor of the shower that is essentially on a level with said surrounding floor 1", in an operative position, in such a way as to form a surface continuity between the latter and the detachable support element 2'.

According to this invention, said peripheral edge 2 of the tub 1 comprises a preferably flat seat surface 2", and the tub 1 is supported in a recess 3 of the floor 1', at least by said seat surface 2" that rests on a belt 3' of said recess 3 at a level that is lower than that of the surrounding floor 1", whereby said seat surface 2" extends by a raised surface 4 whose upper edge 4' is essentially flush with the surrounding floor 1".

The seat surface 2" can extend over all or part of the periphery of the tub 1, preferably on two opposite sides.

The tub 1 can rest on the belt 3' of the recess 3, preferably by means of a putty 8 or another material that makes it possible for the tub 1 to adhere to the inside wall of the recess 3.

The tub 1 can also be supported in the recess 3 by the base 10 of said recess 3 directly or by means of a pin 7 and/or an insulating material 10'.

In addition, it can be seen that the raised surface 4 may have, between the seat surface 2" of the peripheral edge 2 and the upper edge 4' of said raised surface 4, a shoulder 14 that delimits with the latter an inside space 14" for receiving the base of a shower wall 6', 15', whereby said shoulder preferably forms a support surface 14' that is designed to be in contact with said base of a shower wall 6', 15, preferably by means of a sealing joint 9.

Such a shower wall 6' or 15 can be, for example, either a shower partition 15 or a wall covering 6'.

It will be noted that in a variant of this invention, not shown, the seat surface 2" can advantageously be integrated into the shoulder 14 and can preferably consist of the outside surface that forms the other face of the portion of said shoulder 14 that comprises the support surface 14' that forms the inside face of said portion.

It can also be seen in FIG. 1*a* that a shower partition 15 is raised between the surrounding floor 1" and a grating that forms the detachable support 2', i.e., by inserting the base of said partition 15 into the gap 15' that corresponds to the empty space between the raised surface 4 and the grating 2'. The base of the shower partition 15 is supported by a section 13 that can be hooked onto the upper edge 4' of the raised surface 4 while resting on the support surface 14' so as to be able to solidly support the shower partition 15.

The section can have an overall shape of an upside-down W, i.e., with a cross-section that consists of a series of two curves in the opposite direction, each as a whole being a U-shape. One of the two U-shapes, more particularly one that is open toward the bottom, then forms a hook that makes it possible to hook the section 13 to the upper edge 4' of the raised surface 4. The other upside-down U-shape, more particularly one that is open toward the top, rests by its base on the support surface 14' and is designed to accommodate the base of the shower partition 15 in the mounted and raised position.

It can also be seen that the section 13 rests, by the U-shape that is open toward the top, on the support surface 14' by means of a sealing joint 9 such as, for example, a flexible joint, preferably made of silicone.

A connecting means such as a mortar 16 fills the space between the raised surface 4 and the inside wall of the recess 3 of the tub 1 in such a way as to reinforce the attachment of the tub 1 in the recess 3. The mortar 16 also makes it possible to stiffen the support surface 14' of the raised surface 14 that is advantageously designed to support a shower partition 15 by means of a section 13.

Figure 1B:
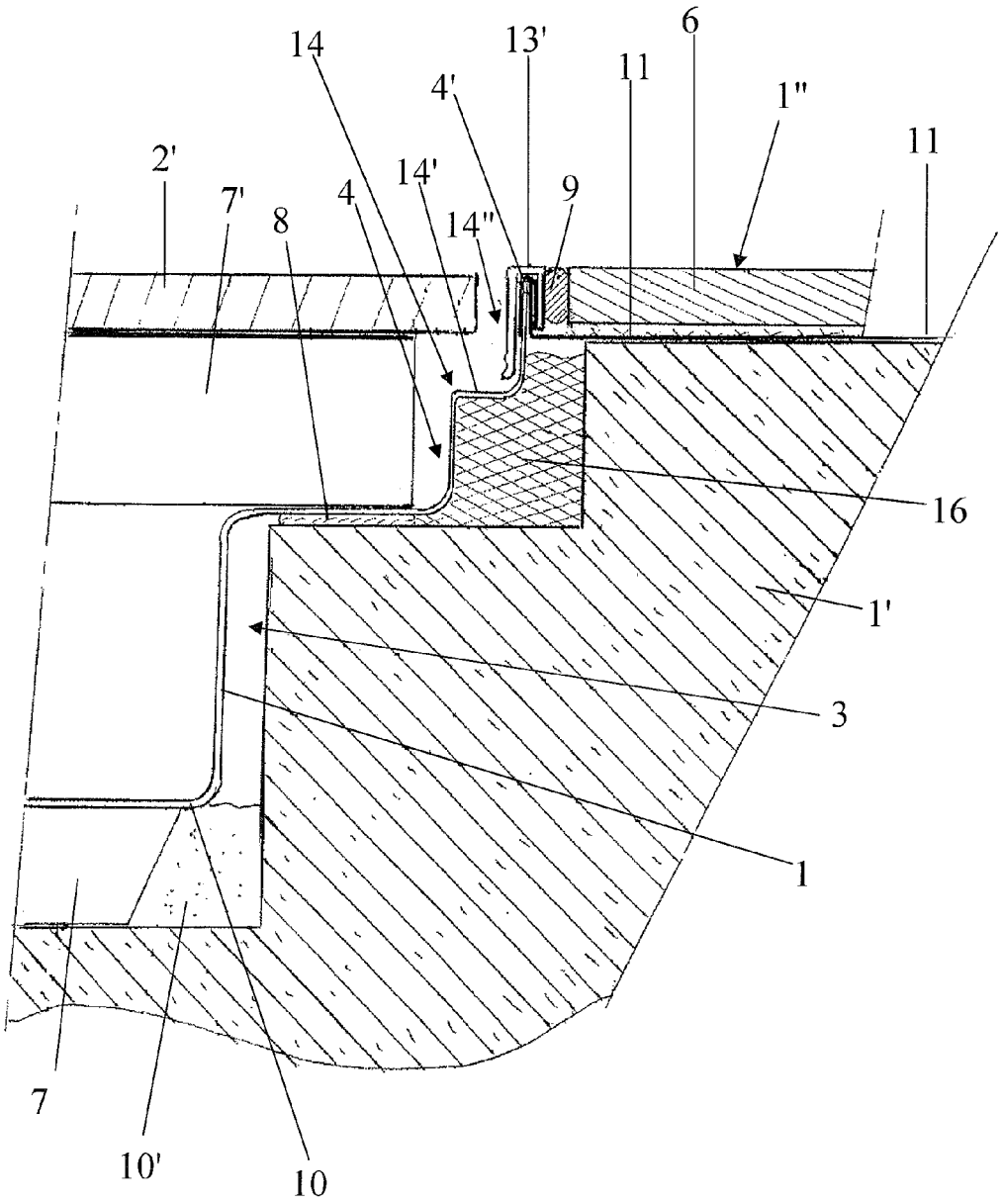
FIG. 1*b* is a detail view of FIG. 1*a* that shows the portion of the edge of the shower tub according to the invention that is flush with the surrounding floor.

The surrounding floor 1" can consist of, for example, a floor covering such as tiles or paving 6. In this case, a sealing mat 11 can be inserted between the floor covering 6 and the floor 1' on which said floor covering 6 is laid (FIG. 1*b*). The sealing mat 11 extends to the inside surface of the raised surface 4, adjacent to the floor 1, in such a way as to form an airtight seal with said raised surface 4 to insulate the floor 1 from the sprayed shower water.

The sealing mat 11 reinforces the seal created by the installation of the flexible sealing joint 9.

In a configuration without a shower partition 15 between the tub 1 and the surrounding floor 1", as can be seen in FIG. 1*b*, a section 13', with an overall U-shaped cross-section, tightly covers the upper edge 4' of the raised surface 4 of the peripheral edge 2 of the tub 1 and the corresponding portion of the sealing mat 11 in such a way as to ensure an airtight seal between said sealing mat 11 and said raised surface 4 at its upper edge 4'.

Nevertheless, in this configuration, a conventional shower partition can be set up on the surrounding floor 1" at a point away from the peripheral edge 2 of the tub 1, and the sealing mat 11 can extend up to said partition in such a way as to be made integral, with sealing, with the bottom portion of the latter.

In a configuration with a shower partition 15 (FIG. 1*a*) between the tub 1 and the surrounding floor 1", one of the two Us that forms a hook, more particularly one that is open toward the bottom, of the section 13, described above, will advantageously tightly cover the upper edge 4' of the raised surface 4 of the peripheral edge 2 of the tub 1 and the corresponding portion of the sealing mat 11, such as the one that is shown in FIG. 1*a*, to form an airtight seal between said sealing mat 11 and said raised surface 4 at its upper edge 4'.

In a variant of the sealing joint in the U-shaped section 13', or in the upside-down-W-shaped section 13, the sealing mat 11 is made by being embedded in a paste that hardens in air, such as a putty, incorporated inside the U-shape of the corresponding section 13, or 13'.

In a first particular embodiment of the tub 1 according to the invention in a shower space, the entire periphery of the peripheral edge 2 of the tub 1 is essentially flush with the surrounding floor 1".

Figure 3:
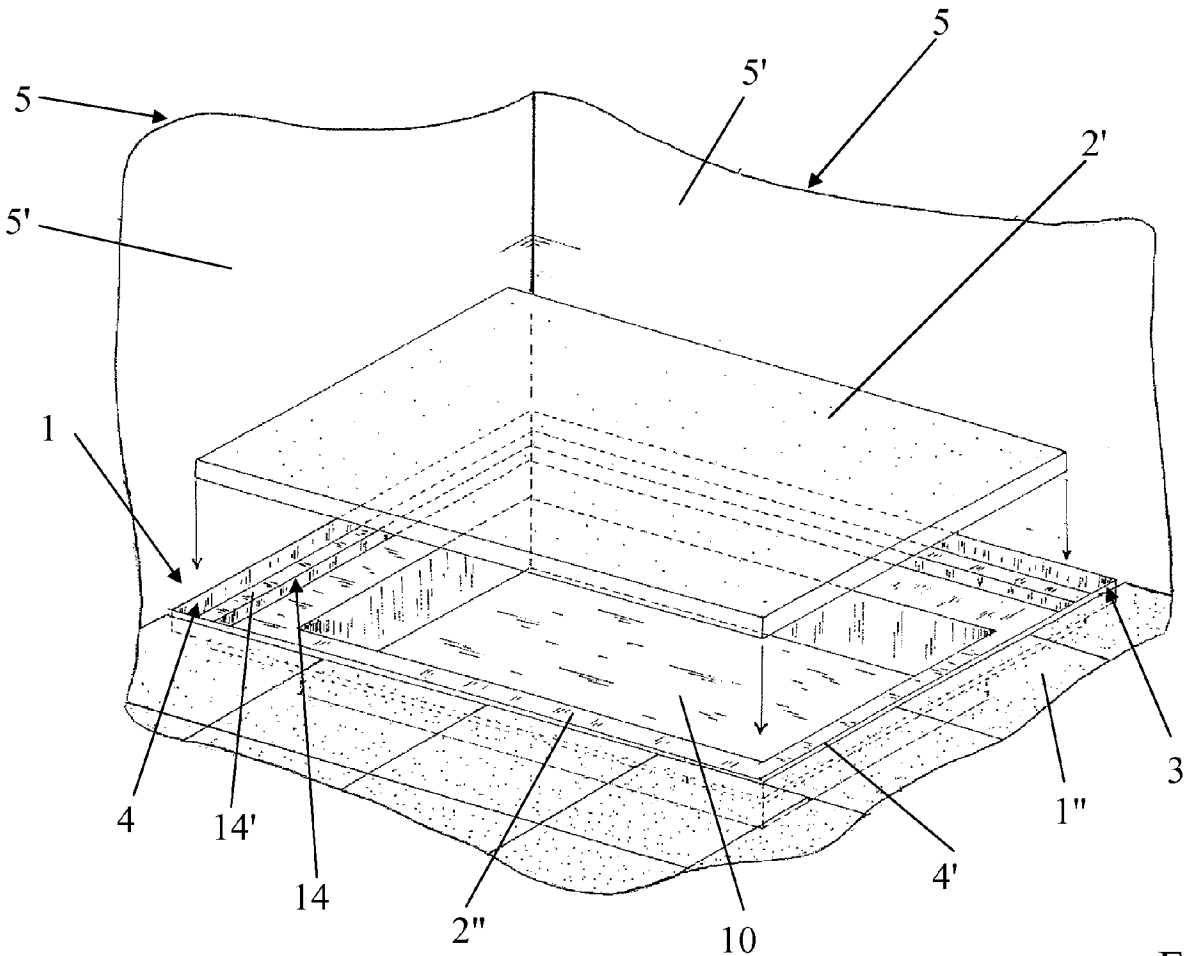
FIG. 3 is a perspective view of a level shower according to the invention with a tub that is embedded in a wall space.

In a second embodiment of the tub 1 according to the invention in a shower space, as can be seen in FIG. 1*a* and in FIG. 3, the tub 1 is embedded in a wall space in such a way that a portion of the periphery of the peripheral edge 2 of the tub 1 is essentially flush with the surrounding floor 1" while the other portion of the periphery of said peripheral edge 2 is adjacent to at least one wall side 5.

In the description below, wall side will be referred to as a vertical wall side 5 or a wall for separating a living space, optionally covered by an insulating material 5'.

FIG. 1*a* shows that each wall side 5 can be covered by a wall covering 6' and that the raised surface 4 of the peripheral edge 2 of the tub 1 is inserted, with sealing, between the bottom portion of said wall covering 6' and the corresponding bottom portion of the wall side 5.

The raised surface 4 can be attached to the wall side 5 using an attachment means such as a putty 8, and the airtight seal between the inside surface of the raised surface 4 and the bottom portion of the wall covering 6' can be made by means of a flexible sealing joint such as a silicone joint 9.

Thus, the tub 1 can be embedded in the floor 1' of a wall space that is delimited by a wall side 5, equipped with a water distribution installation, not shown, or several wall sides 5, as can be seen in FIG. 3, at least one of which will be equipped with a water distribution installation, not shown, whereby each wall side 5 is designed to be covered by a wall covering 6' (FIG. 1*a*).

More specifically, the outside surface of the portion of the raised surface 4, in particular the outside surface on the top, if necessary the shoulder 14, rests against the wall side 5 by means of an attachment means 8 such as a putty. The bottom portion of the wall covering 6' is positioned in the inside space 14" for receiving the raised surface 4, located above the shoulder 14, by preferably coming into contact with the support surface 14', preferably by means of a flexible sealing joint such as a silicone joint 9.

However, to better reinforce the seal of the tub 1, on the wall side 5, a sealing mat 11 can also be inserted between the wall covering 6' and the wall side 5 and can extend into the inside receiving space 14" up to the bottom portion of the wall side 5, between the bottom portion of the wall covering 6' and the corresponding inside surface of the raised surface 4.

In the case where the wall covering 6' or the floor covering 6, for example tiles, is attached either on the wall side 5 or on the floor 1' of the surrounding floor 1" by means of a product such as a glue 6", the sealing mat 11 is advantageously immersed in said glue 6".

The width of the support surface 14', formed by the shoulder 14 of the raised surface 4, is preferably a width that is approximately equal to the thickness of the wall covering 6', including the glue for tiles and optionally the sealing mat 11.

The width of the support surface 14' is also determined to preferably be approximately equal to the width of a section 13 or 13'.

Thus, on the surrounding floor 1" side, it is possible to create a surface continuity between the inside surface of a section 13 or 13' and the inside surface of the raised surface 4 that is located below the shoulder 14 in such a way that the shower water that runs down the corresponding walls does not act on the seal created in particular by the sealing joint 9 that ensures the sealing between the section and the support surface 14'.

Likewise, on the side of the wall side 5, it is possible to create a surface continuity between the outside surface of the wall covering 6' and the inside surface of the raised surface 4 that is located below the shoulder 14 in such a way that the shower water that runs down the corresponding walls does not act on the seal created in particular by the sealing joint 9 that ensures the seal between the base of the wall covering 6' and the support surface 14'.

FIG. 3 shows a rectangular tub 1 that is embedded in the floor 1' of a wall space that comprises two contiguous wall sides 5 at a right angle. The inside surface of the tub 1 is able to receive a grating 2' that is designed to be put on a level with the surrounding floor 1" by resting on the seat surface 2" of the peripheral edge 2, optionally by means of an integrated base 7'. The tub 1 comprises two sides that are adjacent to the wall sides 5 and two sides that are adjacent to the surrounding floor 1", imparting a surface continuity, without obstacle, on two sides of the tub 1 between the outside surface of the grating 2' that forms the floor of the shower and the surrounding floor 1".

Of course, the invention is not limited to the embodiment that is described and shown in the accompanying drawings. Modifications are possible, in particular from the standpoint of the composition of the various elements or by substitution of equivalent techniques, without thereby exceeding the field of protection of the invention. Thus, a wall side can be encompassed as any type of vertical wall or partition made of any materials, wood, plaster, concrete, etc., and the tub can assume all shapes, polygonal, circular or oval, or else mixed, polygonal and round, for example.

The invention claimed is:

1. A shower device level with a surrounding floor (1"), comprising:

a recovery surface for recovery of waste water combined with a drain for draining said water, said recovery surface comprising a tub (1) embedded in a floor (1'), said tub having a periphery with a peripheral edge (2), said periphery edge (2) being essentially flush with said surrounding floor (1"), said tub having a detachable support element (2'), said detachable support element forming a shower floor, the detachable support element being essentially at a level with said surrounding floor (1"), in an operative position, to form a surface continuity between the surrounding floor (1") and the detachable support element (2'), said peripheral edge (2) comprising a flat seat surface (2"), said seat surface (2") comprising a raised surface (4) with an upper edge (4'), the floor (1') having a recess (3) with a belt (3'), and the recess (3) supporting the tub (1) at least by said seat surface (2") resting on the belt (3') of said recess (3) so that i) the tub (1) is at a level below a level of the surrounding floor (1") and ii) said upper edge (4') of said raised surface (4) of said seat surface (2") is essentially flush with the surrounding floor (1").

2. The device, according to claim 1, wherein, the raised surface (4) comprises, between the seat surface (2") of the peripheral edge (2) and the upper edge (4') of said raised surface (4), a shoulder (14), the shoulder (14) delimiting an inside space (14") for receiving a base of a shower wall (6, 15), and said shoulder (14) forms a support surface (14') in contact with said base of a shower wall (6, 15).

3. The device, according to claim 2, further comprising:

a section (13) hooked to the upper edge (4') of the raised surface (4), wherein, the shower wall is a shower partition (15), and the base of the shower partition (15) rests on the support surface (14') of the shoulder (14) via the section (13).

4. The device, according to claim 3, wherein, the section (13) has a cross-section comprising a series of two curves in the opposite direction, each curve, as a whole is U-shaped, a first of the two U-shaped curves forms a hook hooking said section (13) to the upper edge (4') of the raised surface (4), a second of the two U-shaped curves has a base resting on the support surface (14') and accommodating the base of the shower partition (15).

5. The device, according to claim 1, wherein a sealing joint (9) provides an airtight seal between the surrounding floor (1") and the raised surface (4) of the tub (1).

6. The device, according to claim 5, wherein, the surrounding floor (1") comprises a floor covering (6) laying on the floor (1), a sealing mat (11) is between the floor covering (6) and the floor (1'), and said sealing mat (11) extends to an inside surface of the raised surface (4) and forms an airtight seal with said raised surface (4).

7. The device, according to claim 6, wherein a section (13') with an overall U-shaped cross-section tightly covers the upper edge (4') of the raised surface (4) of the peripheral edge (2) of the tub (1) and a corresponding portion of the sealing mat (11) and thereby forms an airtight seal between said sealing mat (11) and the upper edge (4') of said raised surface (4).

8. The device, according to claim 6, wherein the first of the two U-shaped curves of the section (13) tightly covers the upper edge (4') of the raised surface (4) and a corresponding portion of the sealing mat (11) and thereby forms an airtight seal between said sealing mat (11) and the upper edge (4') of said raised surface (4).

9. The device, according to claim 7, wherein the sealing mat (11) is located within a corresponding U-shaped part of the section (13') with the overall U-shaped cross-section.

10. The device, according to claim 1, wherein the entire periphery of the peripheral edge (2) of the tub (1) is essentially flush with the surrounding floor (1").

11. The device, according to claim 1, wherein, the tub (1) is embedded in a wall space having a side wall (5), and the tub has i) a first portion of the periphery of the peripheral edge (2) of the tub (1) being essentially flush with the surrounding floor (1"), and ii) a second portion of the periphery of said peripheral edge (2) of the tub being adjacent to the wall side (5).

12. The device, according to claim 11, wherein, the wall side (5) is covered by a wall covering (6') and the raised surface (4) of the peripheral edge (2) of the tub (1) is inserted, with sealing, between a bottom portion of said wall covering (6') and a corresponding bottom portion of said wall side (5).

13. The device, according to claim 11, wherein a sealing joint (9) provides an airtight seal between the bottom portion of the wall covering (6') and a corresponding inside surface of the raised surface (4).

14. The device, according to claim 12, wherein, a sealing mat (11) is located between the wall covering (6') and the wall side (5), and said sealing mat (11) extends up to the bottom portion of the wall side (5) between the raised-surface portion (4) and the bottom portion of said wall covering (6').

15. The device, according to claim 1, wherein the seat surface (2") is integrated in the shoulder (14).

16. The device, according to claim 8, wherein the sealing mat (11) is located within a corresponding U-shaped part of the section (13') with the overall U-shaped cross-section.

17. The device, according to claim 12, wherein a sealing joint (9) provides an airtight seal between the bottom portion of the wall covering (6') and a corresponding inside surface of the raised surface (4).

18. The device, according to claim 13, wherein a sealing mat (11) is located between the wall covering (6') and the wall side (5) and wherein said sealing mat (11) extends up to the bottom portion of the wall side (5) between the raised-surface portion (4) and the bottom portion of said wall covering (6').

* * * * *